US006062292A

United States Patent [19]

Bryant

[11] Patent Number: 6,062,292

[45] Date of Patent: May 16, 2000

[54] WINDOW BLIND WITH STORAGE RAIL

[76] Inventor: David C. Bryant, 5562 N. Elston Ave., Chicago, Ill. 60630

[21] Appl. No.: 09/240,188

[22] Filed: Jan. 29, 1999

Related U.S. Application Data

[63] Continuation-in-part of application No. 09/198,962, Nov. 24, 1998, Pat. No. 5,927,366, which is a continuation of application No. 09/097,499, Jun. 15, 1998, and a continuation of application No. 08/649,461, May 17, 1996, Pat. No. 5,765,621, which is a continuation-in-part of application No. 08/444,270, May 18, 1995, Pat. No. 5,655,590.

[51] Int. Cl.[7] ..... E06B 9/30

[52] U.S. Cl. ..... 160/178.1 R; 160/173 R

[58] Field of Search ..... 160/168.1 R, 178.1 R, 160/178.3 R, 169 R, 167 R, 176.1 R

[56] References Cited

U.S. PATENT DOCUMENTS 5,655,590 8/1997 Bryant ..... 160/178.1 R 5,765,621 6/1998 Bryant ..... 160/199

5,926,366 7/1999 Bryant ..... 160/168.1 R

FOREIGN PATENT DOCUMENTS 2347806 11/1977 France ..... 248/909

*Primary Examiner*—Blair M. Johnson

*Attorney, Agent, or Firm*—Trexler, Bushnell, Giangiorgi & Blackstone, Ltd.

[57] ABSTRACT

A window blind assembly having a storage rail assembly that includes a storage rail defining a channel for receiving and storing unnecessary or unused slats of the blind assembly to enable the ready customization of the blind assembly to fit windows of different heights. The storage rail assembly also includes a pair of end caps removably engageable with the ends of the storage rail for retaining the slats within the channel. Each end cap includes a breakaway member and an end piece removably joined together by a coupling portion desirably in the form of an area of reduced thickness of the end cap so that the breakaway member can be separated from the end piece and positioned to prevent buckling of the slats within the blind.

22 Claims, 5 Drawing Sheets

WINDOW BLIND WITH STORAGE RAIL

This application is a continuation-in-part of U.S. patent application Ser. No. 09/198,962, filed Nov. 24, 1998, now U.S. Pat. No. 5,927,366, which is a continuation of U.S. patent application Ser. No. 09/097,499, filed Jun. 15, 1998, which is a continuation of U.S. patent application Ser. No. 08/649,461, filed May 17, 1996, now U.S. Pat. No. 5,765,621, which is a continuation-in-part of U.S. patent application Ser. No. 08/444,270, filed May 18, 1995, now U.S. Pat. No. 5,655,590.

FIELD OF THE INVENTION

The present invention relates to window blinds, and, more particularly, the customization of window blinds to fit windows of different heights.

BACKGROUND

U.S. Pat. Nos. 5,655,590 and 5,765,621 disclose, among other things, a generally hollow and elongated bottom storage rail for an extensible window blind assembly having a plurality of interconnected slats for receiving or storing unnecessary or excess slats of the blind assembly. The storage rail enables the blind assembly to be customized or adjusted readily to be used with windows of different heights without having to remove or disconnect the unnecessary slats from the rest of the blind assembly.

A blind assembly including the storage rail disclosed in the '590 and '621 patents is well suited for "inside window mounts," which are mounts of the blind assembly to a window frame having a bottom ledge such that the storage rail rests on the bottom ledge when the blind assembly is in its extended position. Although the blind assembly including the storage rail disclosed in these patents also works well for "outside window mounts," which are mounts of the blind assembly to or in connection with a window not having a window frame with a bottom ledge, it is possible that such outside window mounts can result in buckling of the slats stored within the storage rail. Depending on the weight of the storage rail and the stored slats, any such buckling may tend to occur due to the lack of support from a bottom ledge of a window frame supporting the storage rail.

Accordingly, it is an object of the present invention to provide a storage rail assembly that includes the benefits of the '590 and '621 patents, but that also prevents any buckling of slats stored within the storage rail.

It is a further object of the present invention to provide such a storage rail assembly that is particularly well suited for outside window mounts.

SUMMARY

In accordance with these and other objects, the present invention provides a storage rail assembly for a blind assembly including a plurality of interconnected slats. The storage rail assembly comprises an elongated storage rail and an end cap associated with an end of the storage rail. The storage rail includes a pair of opposed walls of the storage rail defining a channel for receiving some of the slats. The end cap includes a breakaway member, end piece, and a coupling portion removably coupling or otherwise joining together the breakaway member and the end piece. The breakaway member is adapted to be separated from the end piece and to be engageable with the opposed walls of the storage rail desirably anywhere along the length of the storage rail for substantially preventing any of said some of the slats from buckling outside of the storage rail. The coupling portion may comprise an area of reduced thickness or be in any other suitable form that facilitates separation of the breakaway member from the end piece.

To customize or shorten to a desired length the blind assembly having a storage rail assembly in accordance with a preferred embodiment of the invention, after the blind assembly is secured to a window frame or otherwise secured in connection with a window, the user manually gathers and inserts into the channel of the storage rail the unnecessary slats. Desirably, a pair of the end caps are then used to retain the slats within the storage rail and the breakaway members of the end caps are used to substantially prevent any buckling of any of those slats and thereby also to retain the slats within the storage rail.

The breakaway members can be separated from the end pieces and installed in any suitable manner and either before, during or after the engagement of the end caps with respective ends of the storage rail. In accordance with a preferred embodiment, for example, after the end caps are engaged with respective ends of the storage rail, one of the end caps is slid outwardly so that the area of reduced thickness aligns with the respective end of the storage rail and the end piece of the end cap extends from the storage rail. While the breakaway member remains engaged with the respective end of the storage rail, an upward manual pressure is then applied to the end piece sufficient to cause the end cap to break at the coupling portion and the breakaway member to thereby breakaway or separate from the end piece. The separated breakaway member can then be slid or otherwise moved to a desired location along the length of the storage rail desirably adjacent one of the cords of the window blind assembly, and the end piece re-engaged with the respective end of the storage rail. These steps desirably are repeated with the other end cap on the other end of the storage rail so that each breakaway member is positioned adjacent a respective cord of the window blind assembly.

Thereafter, the installer may engage to the breakaway members and the end pieces a cover slat, which is the slat located next above the storage rail. The unnecessary slats are thus retained within the storage rail, and the breakaway member prevents or reduces any buckling of the unnecessary slats or the cover slat. The window blind assembly can then be raised or lowered in a conventional manner.

The present invention provides a window blind assembly that can be customized to fit window frames of different heights quickly and easily without the use of any tools, and that prevents buckling of stored slats within the storage rail of the blind assembly, which may occur especially with outside window mounts. Thus, the present invention not only provides the benefits of the '590 and '621 patents, but also prevents buckling of the stored slats.

The present invention enables individuals to install a blind assembly with minimal effort and without the need to consult professionals. Moreover, if the installer is an individual or company that is frequently installing window blind assemblies on a single property or multiple properties, such as a property manager or landlord, the present invention can save countless man hours and substantial expense. The present invention also may extend the useful life of the window blind assembly since it enables the window blind assembly to be quickly and easily lengthened or further shortened without the need to disconnect any of the interconnected slats of the blind assembly. Thus, the blind assembly is reusable with other windows and can be quickly and easily switched to a different size window, if desired. In addition, the holes that are drilled in the bottom rails of the prior art window blind assemblies to enable the blind assemblies to be shortened are eliminated in the present invention. By eliminating the holes, the present invention saves the time and expense of drilling holes in the bottom rail and also enhances the aesthetics of the rail.

Further, the present invention in accordance with a preferred embodiment eliminates the bottom plugs and the bottom ladder tape that extends around and beneath the bottom rail. As a result, the storage rail in accordance with a preferred embodiment does not include unsightly ladder tapes or plugs. Because of its construction, the storage rail preferably also achieves substantially equal spacing between the individual slats that extend outside the storage rail when the blind assembly is in an extended position.

The storage rail also provides benefits in connection with the packaging of window blinds. For example, wands are usually packed loosely with the other components of the prior art window blind assemblies, and, as a result, the wands often bend or break during storage and transport of the packages containing the assemblies. With the present invention, however, the wand can be stored within the storage rail during packaging, which prevents the wand from bending or breaking. Storage of the wand within the storage rail also reduces the amount of material needed to package the window blind assembly, thereby reducing packaging and transportation costs.

Accordingly, the present invention provides a window blind assembly that can be customized quickly and easily, and that preferably is more aesthetically pleasing and less expensive to manufacture and package than the prior art window blind assemblies. As a result, the present invention is especially advantageous in connection with the popular mini-blind window blind assembly.

BRIEF DESCRIPTION OF THE DRAWINGS

The present invention and the advantages thereof will become more apparent upon consideration of the following detailed description when taken in conjunction with the accompanying drawings.

DESCRIPTION OF THE PREFERRED EMBODIMENTS

Figure 1:
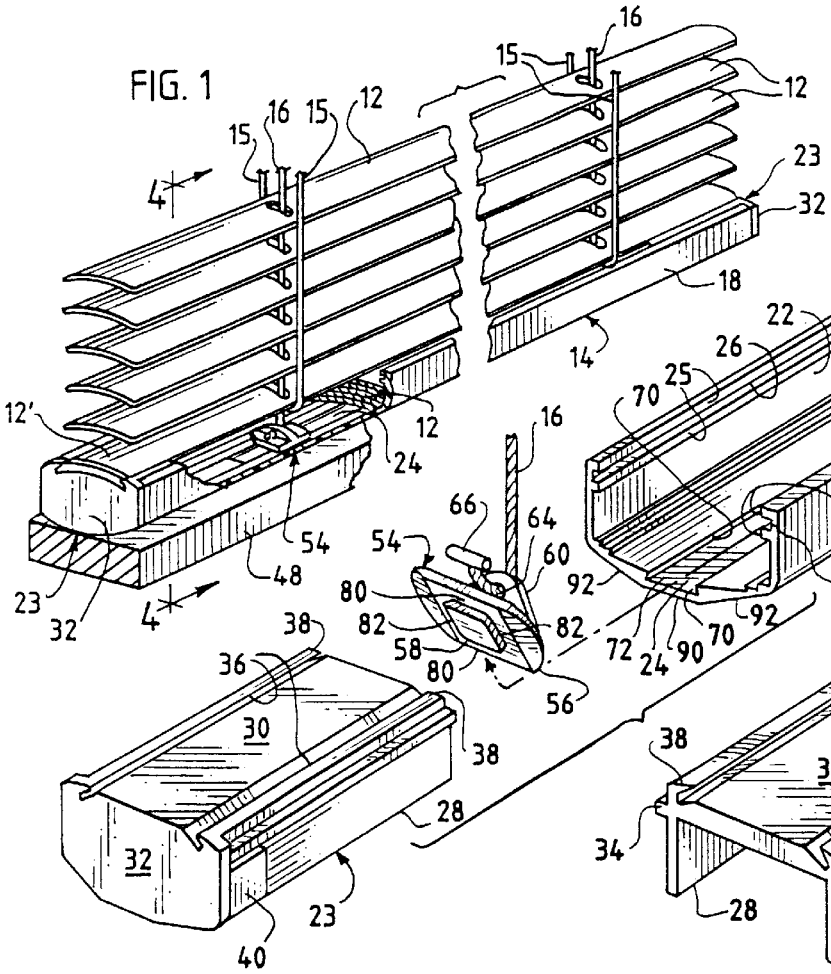
FIG. 1 is a partial perspective view of an extensible window blind that has a bottom storage rail in accordance with one embodiment of the present invention, illustrating in a partial cutaway view the storage rail and the slats retained within the storage rail.

FIG. 1 shows an extensible window blind or window blind assembly 10 comprising a plurality of interconnected slats 12 and a storage rail or bar 14 in accordance with one embodiment of the invention for receiving and storing unnecessary or unused interconnected slats 12 to adjust or shorten the length of the blind assembly. A pair of ladder tapes 15 and a pair of vertical cords 16 interconnect the slats 12, the storage rail 14, and, in accordance with convention, a head rail (not shown) of the blind assembly. The ladder tapes 15 define a plurality of rungs 17 that are disposed between the slats 12 for use in connection with tilting the slats.

In a preferred embodiment, the storage rail 14 is located at a bottom of the blind assembly 10 for storing the unnecessary slats 12 adjacent the bottom of the blind assembly to adjust the length of tie assembly. The storage rail 14 comprises a pair of opposed walls 18 and a base 20 that define an open channel 22 for receiving the unnecessary slats 12. The cross-section of the storage rail 14 is generally U-shaped substantially along its length, with the open channel 22 facing upward. The ends of the storage rail 14 preferably are open. The bottom of the storage rail includes a flat bottom surface 90 that is disposed between a pair of inclined surfaces 92, which extend substantially along the length of the storage rail.

In the embodiment of FIGS. 1–6, a longitudinally-extending and generally U-shaped slot 24 is defined in the base 20 of the storage rail by a pair of slot walls 70 that extend upwardly and inwardly at a slight angle (preferably in the range of 5° to 15°) and a bottom 72. The slot 24 is defined directly above the flat bottom surface 90 and also extends along substantially the entire length of the storage rail 14. The slot 24 is adapted to receive a pair of connecting elements, as hereinafter described.

A pair of end caps 23 may be included that are removably engageable with the ends of the storage rail 14 to enclose the ends of the rail. Each end cap 23 comprises a pair of opposed side walls 28 and a projection which extends into the channel 22 and is adapted to retain the unnecessary slats 12 within the channel. In the embodiment of FIGS. 1–6, the projection is in the form of a tongue or ledge 30 that interconnects the opposed side walls 28. Each end cap 23 also includes an end wall 32 that preferably is of suitable shape to completely cover the open end of the storage rail 14. The tongue 30 extends substantially along the length of the opposed side walls 28 at or adjacent the tops of the side walls. Preferably, when the end caps 23 are engaged with the storage rail 14, the side walls are received substantially within the channel 22 of the storage rail, and the end walls 32 abut the ends of the storage rail (see, e.g. FIG. 1).

The end caps 23 may be engageable with storage rail 14 by a pair of lips 34 defined on the outside of the side walls 28 of the end caps 23 that are slidingly received within passages 26 defined by the storage rail. The lips 34 extend outwardly substantially along the length of each cap 23 and adjacent the tops of the side walls 28. The passages 26 are defined on each opposed wall 18 by a pair of parallel extensions 25 that extend inwardly from the opposed walls substantially along the length of the storage rail 14 adjacent the tops of the opposed walls.

Figure 2:
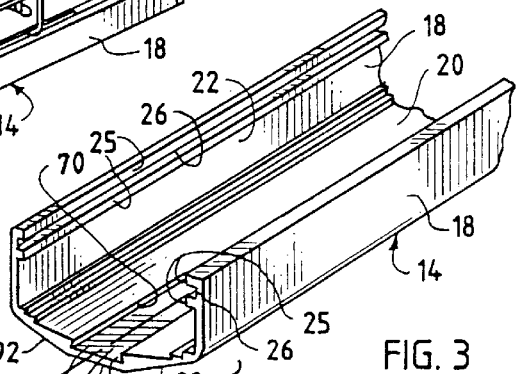
FIG. 2 is an exploded perspective view of the storage rail of FIG. 1 with the slats removed, illustrating a partial perspective view of the storage rail, and a perspective view of one of the end caps engageable with the storage rail and one of the twist-and-lock eyelets for securing the rail to the slats of the blind.
Figure 3:
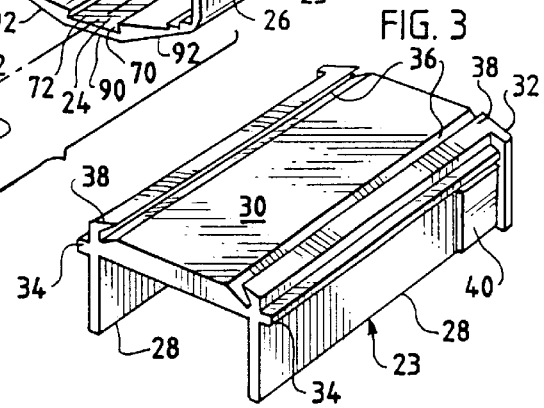
FIG. 3 is a perspective view of the other end cap of the storage rail of FIG. 2.
Figure 4:
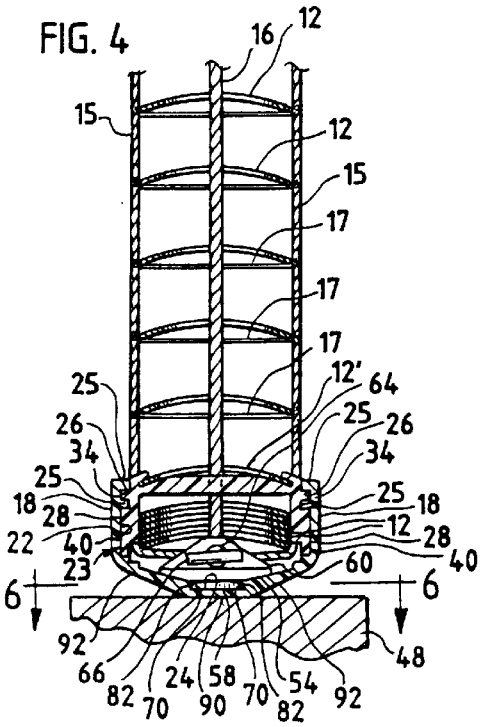
FIG. 4 is a cross section view taken along the plane 44 of FIG. 1.
Figure 5:
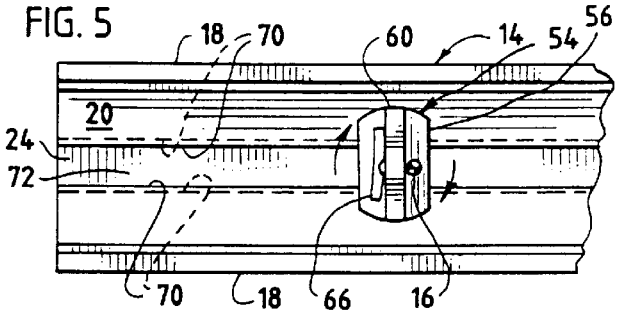
FIG. 5 is a partial plan view of the storage rail of FIG. 2 with one of the twist-and-lock eyelets shown received by the slot defined in the bottom of the storage rail, and illustrating with dashed lines the inclined walls that define the slot.

A pair of inwardly-facing slots 36 may be formed above the tongue 30 by a pair of cantilever members 38 that extend inwardly from the tops of the side walls 28. The slots 36 are adapted to receive the sides of a cover slat 12' to engage the cover slat with the end caps 23 and to substantially enclose the channel 22. The bottom of the cantilever member 38 and the sides of the tongue 30 immediately below the cantilever member 38 may be chamfered, as shown in FIGS. 2 and 3, to complement the slightly bowed configuration of a conventional slat. Alternatively, the extensions 25 of the storage rail 14 may instead (or additionally) be used to engage the cover slat 12' for enclosing the channel. The cover slat 12' enhances the aesthetics of the storage rail 14, facilitates tilting of the storage rail when the slats are tilted, and also may help retain the unnecessary slats 12 within the channel 22 of the storage rail 14.

If desired, additional structure may be included to enhance the engagement of the end cap 23 with the storage rail 14. For example, embossments 40 may be formed on the outside of the side walls 28 of the end cap 23 near the end walls 32 to increase the thickness of the side wall 28 and to provide a pressure fit engagement between the storage rail 14 and the end cap. In the embodiment of FIGS. 2 and 3, the embossments 40 are generally rectangular. If desired, the embossments 40 may be tapered. Alternatively, instead of the embossments 40, the outside of the side walls 28 may be tapered to enhance the engagement of the end cap 23 with the storage rail 14.

The width and length of the storage rail 14 preferably complement the width and length of the slats 12. For example, the distance between the opposed walls 18 preferably is in the range of ⅞" to 1⅛" or a slat that is 1" wide. The length of the storage rail 14 preferably is in the range of 23½" to 24" for a slat that is 23½" long. The height of the storage rail 14 depends upon the size of the blind assembly 10 and upon the desired aesthetics.

The height of the side walls 28 of the end caps 23 is substantially equal to or preferably less than the height of the opposed walls 18 of the storage rail 14. The tongue 30 and side walls 28 of the end cap 23 may have any suitable length, but preferably the two lengths are approximately the same so that the tongue and side walls 28 extend approximately the same distance within the channel 22.

The window blind assembly 10 in accordance with a preferred embodiment of the invention preferably is readily customized to achieve the desired height in the following manner. After the window blind assembly 10 is secured to a window frame in any suitable manner, the blind assembly is extended until the storage rail 14 rests on a window sill 48. Then, the unnecessary lower slats 12 are manually gathered and inserted into the storage rail 14. The end caps 23 are then engaged with the ends of the storage rail 14. Next, the cover slat 12' is engaged with the slots 36 formed in the end caps.

Thus, the unnecessary slats 12 are kept or retained within the channel 22 of the storage rail 14 by a retainer. The retainer may be in the form of one or both of the end caps 23, the cover slat 12', or the combination of the end caps and the cover slat. The retainer may instead (or additionally) be defined by any other suitable structure associated with the end caps 23 or the storage rail. For example, the retainer may be defined by one of the pairs of extensions 25 or may be defined by some other form of an extension or projection associated with one or both of the end caps 23 or the storage rail 14. If desired, the retainer could be defined by the end walls 32 of the end caps 23 or the opposed walls 18 of the storage rail which may be spaced apart a predetermined distance so that they are adapted to engage the unnecessary slats to retain them within the channel 22 of the storage rail. The retainer also may be defined by one or more clasps or clips engageable with the storage rail 14 or the end caps 23 that retain the unnecessary slats within the channel 22 of the storage rail 14, or could also be in the form of some type of an adhesive, fastening or magnetic means or structure capable of retaining the unnecessary slats within the channel.

The window blind assembly 10 is adjustable so that the length of the window blind assembly in a fully or otherwise extended position can be customized or adjusted to correspond to the size of the window. The customization of the blind assembly 10 in accordance with the present invention can be completed quickly and easily without the use of tools and without disconnecting any of the interconnected slats 12 from the blind assembly.

If it becomes necessary, thereafter, to secure the blind assembly 10 to another window frame or to lengthen (or shorten further) the blind assembly, the length of the blind assembly can be re-customized by disengaging the cover slat 12', removing the end caps 23 and removing one or more slats 12 from the storage rail 14 (or inserting additional unnecessary slits 12 into the storage rail). The end caps 23 are then replaced on the ends of the storage rail, and another cover slat 12' is secured to the end caps.

The storage rail 14 enhances the aesthetics of the blind assembly in several respects. For example, the ladder tapes 15 and rungs 17 associated with the unnecessary slats 12 extend within (and not around) the storage rail 14, leaving no ladder tapes or rungs to be seen outside or beneath the storage rail (see FIG. 4). The storage rail 14 also eliminates the need for drilling holes in the rail or for the plugs received within the holes. Further, the storage rail 14 preferably facilitates substantially equal spacing between the used slats of the blind assembly (i.e. the slats not stored within the storage rail 14) when the blind assembly is fully extended to enhance the aesthetics and operation of the blind assembly.

Additionally, because the cover slat 12' is engaged with the end caps, the storage rail tilts or pivots when the slats are tilted. The inclined surfaces 92 of the storage rail 14 also facilitate tilting or pivoting of the storage rail on the window sill 48 when the slats 12 are tilted. Thus, when the slats are tilted and the storage rail pivots onto one of the inclined surfaces, the view of the storage rail in one direction is shielded by the cover slat 12'. For example, when the slats 12 are tilted inwardly, the storage rail 14 is substantially hidden from view in the direction facing the inwardly-tilted slats.

The storage rail 14 may be constructed of any suitable material. If desired, the storage rail 14 may be lighter in weight than the prior art bottom rails and still function to keep the blind assembly taut since the slats stored in the storage rail 14 increase the weight of the storage rail. Thus, the storage rail 14 preferably is constructed of a material that is rigid and lightweight, such as, for example, high impact polystyrene.

The storage rail 14 of the present invention may be secured at the bottom of the window blind assembly 10 in any suitable manner. In the preferred embodiment, however, the vertical cords 16 can be quickly and easily secured to the storage rail 14 by a pair of connecting elements joined to the ends of the cords 16. The connecting elements preferably are in the form of twist-and-lock eyelets 54 that are removably engageable with the base of the storage rail 14 within the slot 24.

In the embodiment of FIGS. 1–6, each twist-and-lock eyelet 54 comprises a member 56 having a boss 58 on one side and a bracket 60 on the other side. The bottom of the member 56 may be chamfered at its longitudinal ends to complement the slightly bowed configuration of the base 20 of the storage rail 14. The boss 58 and bracket 60 are preferably integral with the member 56, with the boss extending generally parallel to the member and the bracket extending generally perpendicular to the member.

Figure 6:
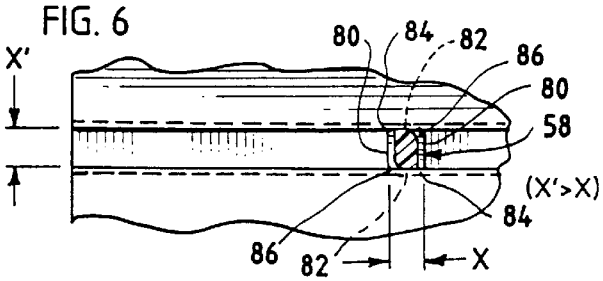
FIG. 6 is a cross section view taken along the lines 6—6 of FIG. 4, illustrating the boss of the twist-and-lock eyelet engaged with the storage rail within the slot and illustrating with dashed lines the inclined walls of the slot and the inclined walls of the boss engaged with the slot walls.

The boss 58 is generally rectangular and is defined by a pair of first walls 80, a pair of second walls 82, a pair of opposed square corners 84 and a pair of opposed rounded corners 86. Preferably, the length of the boss 58 is equal to or slightly less than the width of the slot 24, and the width of the boss 58 is equal to or slightly less than the length of the boss. As illustrated in FIG. 6, the first and second walls extend downwardly from member 56 and outwardly at a slight angle (preferably in the range of 5° to 15°) to complement the slight incline of slot walls 70 of the storage rail 14. Each bracket 60 of eyelet 54 includes an aperture 64 for receiving one of the vertical cords 16, and a bead or tab 66 may be secured to the end of the cord to keep the cord secured to the bracket 60.

To readily secure the cords 16 to the storage rail 14, each twist-and-lock eyelet 54 is inserted into the slot 24 with first walls 80 extending in the direction of the longitudinal axis of the storage rail. The eyelet is twisted approximately 90 degrees relative to the rail 14 to cause the boss 58 to engage slot walls 70. The twisting engagement of the boss with the slot walls is facilitated by the rounded corners 86 which provide a camming effect, and by the inclined slot walls 70 of the storage rail 14 and the inclined first and second walls 80, 82 of the boss 58.

Once the twist-and-lock eyelet 54 and the storage rail 14 are engaged, the eyelets 54 can be moved to a different position along the slot 24 with manual pressure so that the cords can be secured to the storage rail 14 at the desired location. The twist-and-lock eyelets 54 can be disengaged from the rail 14 by twisting the eyelets in the reverse direction.

FIGS. 7–15 illustrate alternative embodiments of the storage rail 114, the pair of end caps 123 and the pair of twist-and-lock eyelets 154. The storage rail 114 illustrated in FIGS. 7 and 8 includes a pair of L-shaped extensions 125 for engaging the pair of end caps 123. Each L-shaped extension projects from one of the opposed walls 118, facing the base 120 of the storage rail 114. If desired, the L-shaped extensions 125 may alternatively (or additionally) engage the cover slat to retain the unnecessary slats 12 within the channel 122 of the storage rail 114 or the L-shaped extensions may themselves retain the unnecessary slats within the channel of the storage. In this regard, due to their configuration, the L-shaped extensions 125 generally may be more effective in engaging and locking the end caps 123 to the storage rail 114, especially when there is a large supply of unnecessary slats.

Figure 9:
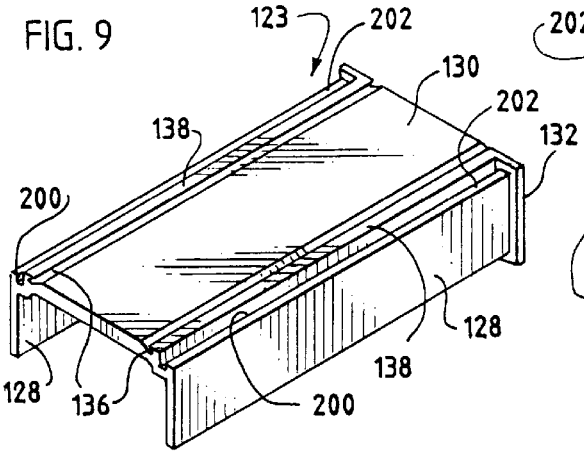
FIG. 9 is a perspective view of one of the end caps engageable with the storage rail of FIGS. 7 and 8.
Figure 10:
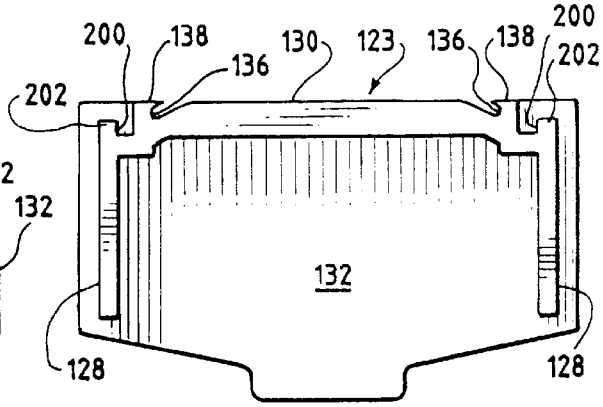
FIG. 10 is an end view of the end cap of FIG. 9.

As illustrated in FIGS. 9 and 10, each end cap 123 includes a pair of opposed side walls 128 joined together by the projection or tongue 130 that preferably is configured to retain the unnecessary slats 12 within the channel 122, and the end wall 132 that is configured to cover the end of the storage rail. A pair of passages 200 is defined on the top of the opposed sides of the tongue 130 for slidingly receiving the L-shaped extensions 125 of the storage rail 114 to engage the end caps with the storage rail. The passages 200 are defined by the tops of the opposed walls 118 of the storage rail and by a pair of walls 202 extending from the top of the tongue. The inwardly-facing slots 136 may be defined by the cantilever members 138, which extend from the walls 202. The cantilever members 138 and a portion of the tongue 130 adjacent the cantilever members may be chamfered to complement the slightly bowed configuration of the conventional slat.

Figure 7:
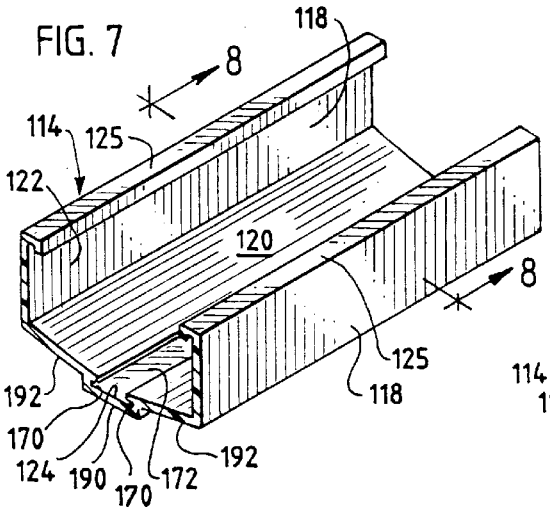
FIG. 7 is a partial perspective view of a bottom storage rail in accordance with another embodiment of the invention.
Figure 8:
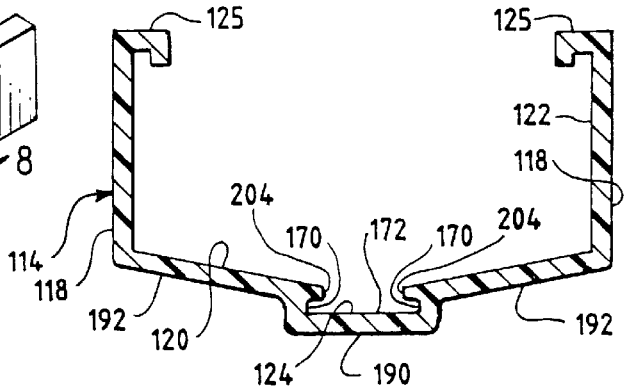
FIG. 8 is a cross section taken along the lines 8—8 of FIG. 7.
Figure 11:
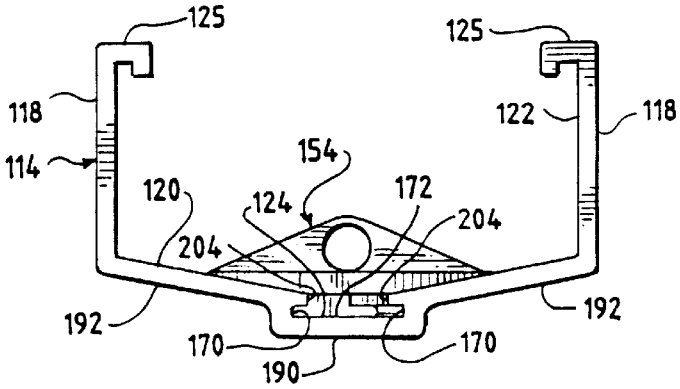
FIG. 11 is an end view of the storage rail of FIGS. 7 and 8 illustrating a twist-and-lock eyelet in accordance with an alternative embodiment for securing the rail to the slats of the blind.
Figure 12:
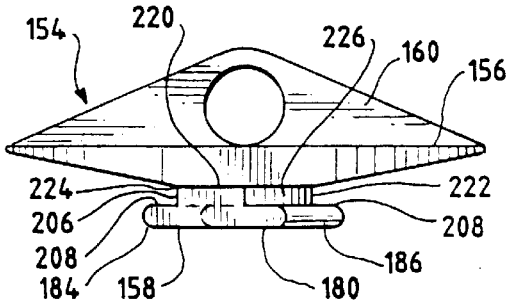
FIG. 12 is an enlarged view of the twist-and-lock eyelet of FIG. 11.
Figure 15:
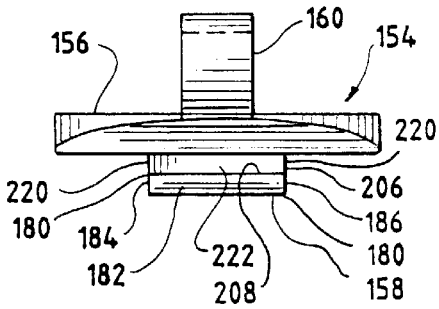
FIG. 15 is an end view of the twist-and-lock eyelet of FIGS. 11–14.
Figure 13:
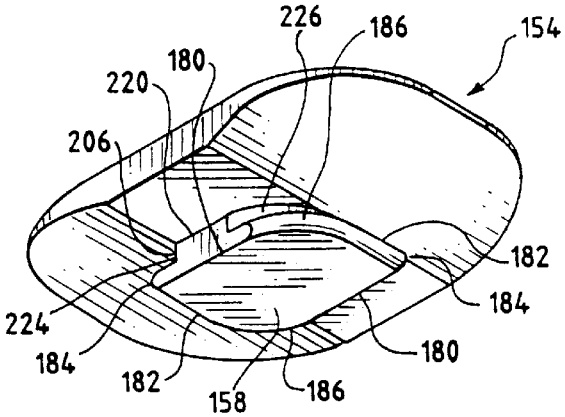
FIG. 13 is a perspective view of the bottom of the twist-and-lock eyelet of FIGS. 11–12.
Figure 14:
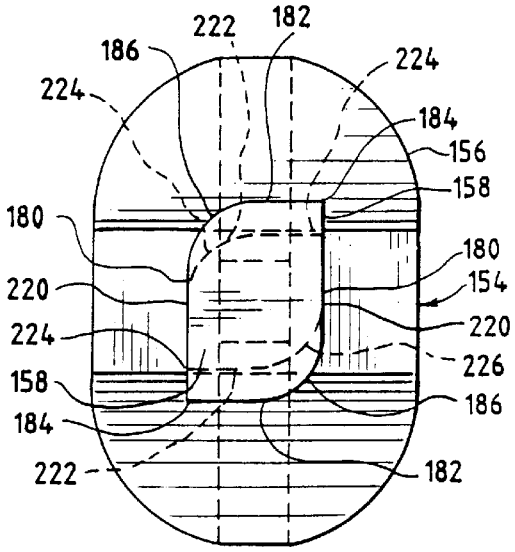
FIG. 14 is a bottom view of the twist-and-lock eyelet of FIGS. 11–13.

The slot 124 of the storage rail 114 is adapted to engage the twist-and-lock eyelet 154 of FIGS. 11–15. As illustrated in FIGS. 7, 8 and 11, the slot 124 is defined by the pair of slot walls 170, the bottom 172, and a pair of opposed shoulders 204 that extend substantially along the length of the rail 14.

Each twist-and-lock eyelet 154 includes the member 156, the boss 158, the bracket 160, and a neck 206 joining the member and the boss. The boss 158 and the neck 206 define a pair of channels 208 adapted to receive the shoulders 204 of the storage rail 114 when the eyelet 154 is engaged within the slot 124.

The boss 158 of each twist-and-lock eyelet 154 is generally rectangular and is defined by a pair of generally parallel first walls 180, a pair of generally parallel second walls 182, a pair of opposed square corners 184, and a pair of opposed rounded corners 186. Preferably, the length of boss 158 is equal to or slightly less than the width of the slot 124, and the width of the second walls 182 is equal to or slightly less than the length of the boss. The opposed rounded corners 186 facilitate a camming effect when the twist-and-lock eyelets 154 are twisted and engaged within the slots 124. In the embodiment illustrated in FIGS. 11–15, the first and second walls 180 and 182 are not inclined.

Preferably, the neck 206 has a similar construction to the boss 158 except that it is shorter in length than the boss. The neck 206 may be generally rectangular or square and is defined by a pair of generally parallel first walls 220, a pair of generally parallel second walls 222, a pair of opposed square corners 224 and a pair of opposed rounded corners 226. Preferably, the length of neck 206 is equal to or slightly less than the distance between the opposed shoulders 204 of the storage rail, and the width of the neck 206 is the same as the width of the boss 158. The opposed rounded corners 226 facilitate a camming effect with the shoulders 204 when the twist-and-lock eyelets 154 are twisted and engaged within the slots 124.

Figure 16:
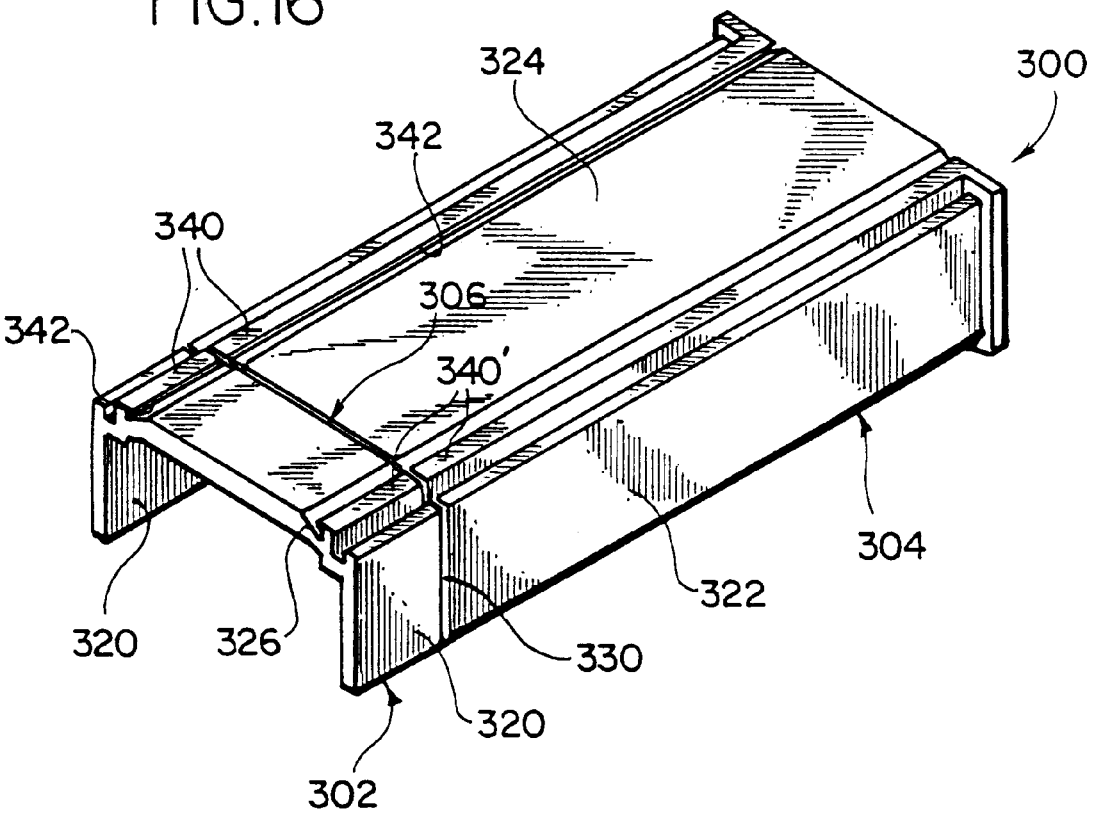
FIG. 16 is a perspective view of one of the end caps in accordance with a further embodiment of the invention comprising a breakaway member for securing to the storage rail along the length thereof.
Figure 17:
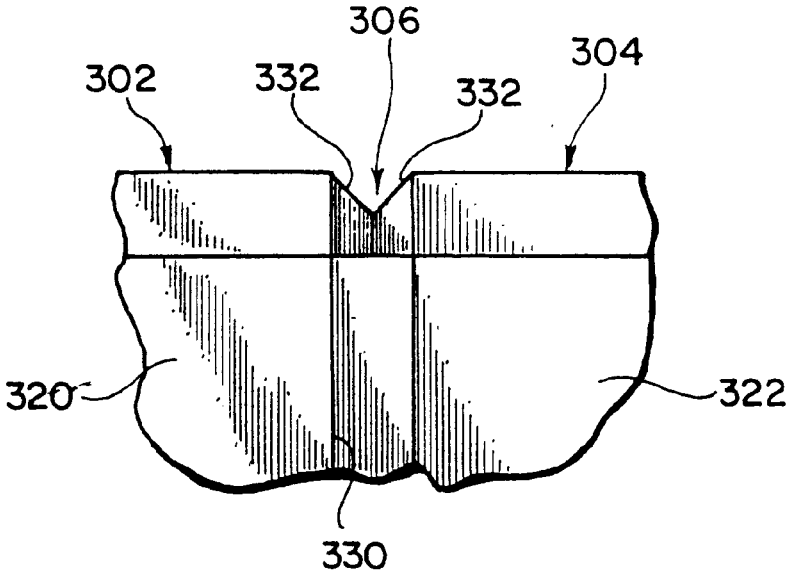
FIG. 17 is a side view of the end cap of FIG. 16.
Figure 18:
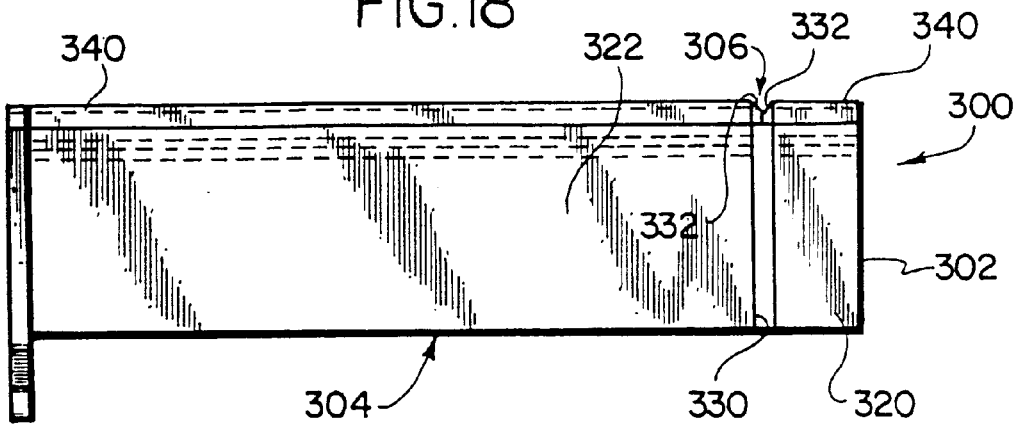
FIG. 18 is an enlarged view of the area of reduced thickness of the end cap of FIGS. 16 and 17.

FIGS. 16–19 disclose alternative embodiments of the end caps which are adapted to prevent any buckling of slats 12 contained within the storage rail 14 and desirably also to retain the unnecessary Slats within the storage rail. FIGS. 16–18 disclose an end cap designated 300, which includes a breakaway member 302, an end piece 304, and a coupling portion 306 removably coupling or otherwise joining together the breakaway member and the end piece such that the breakaway member can be readily separated from the end piece. After separation from the end piece 304, the breakaway member 302 can be secured at a desired location along the length of the walls 18 of the storage rail 14 to prevent or reduce any buckling of the slats 12 stored within the storage rail 14. In a preferred embodiment, for example, each breakaway member 302 desirably is positioned adjacent a respective cord 16 where buckling is most likely to occur. Depending on the length of the storage rail 12, it may be desirable to position the breakaway members 302 on the storage rail 14 either between or outside the cords 16.

The breakaway member 302, the end piece 304 and the coupling portion 306 may have any suitable construction that desirably facilitates quick and easy separation of the breakaway member from the end piece. In the illustrated embodiment, for example, the breakaway member 302 and the end piece 304 of the end cap 300 each includes a pair of opposed walls 320 and 322, respectively, and the end cap also includes a connecting member 324 connecting together the opposed walls 320 of the breakaway member 302 and connecting together the opposed walls 322 of the end piece 304. The illustrated coupling portion 306 is in the form of an area of reduced thickness formed on the connecting member 324 adapted to break upon application of a manual force to the end piece 304. The illustrated cap 300 defines al pair of gaps 330, each gap being defined on a respective side of the end cap 300 and separating one of the opposed walls 320 from one of the opposed wall 322 to further facilitate quick and easy separation.

Figure 20:
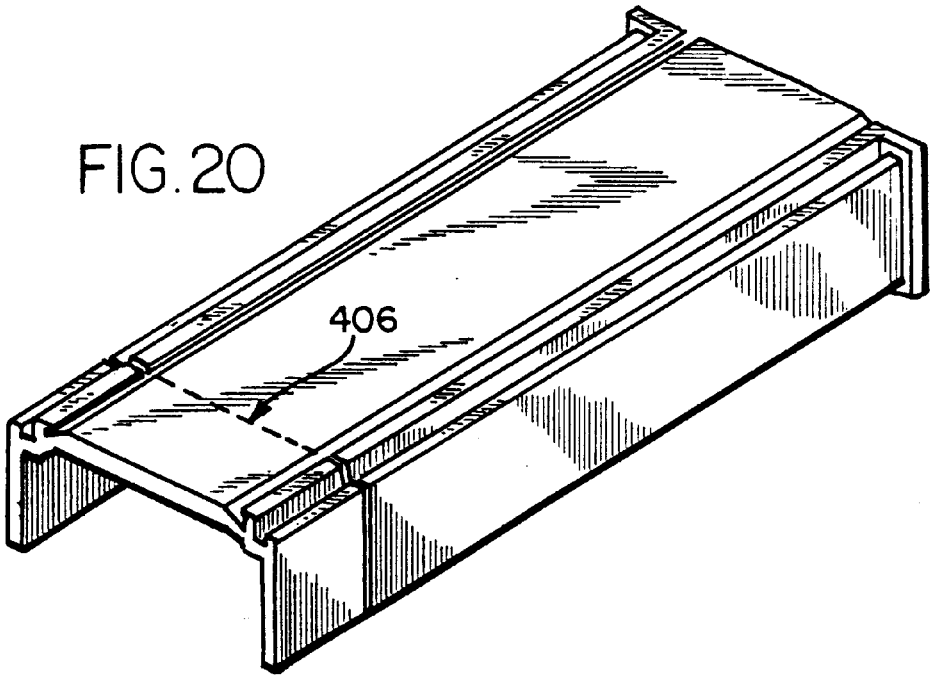
FIG. 20 is a perspective view of one of the end caps in accordance with a further embodiment of the invention comprising a breakaway member for securing to the storage rail along the length thereof, illustrating perforations for separating the breakaway member.

The illustrated area of reduced thickness is defined by a pair of inclined walls 332 on the connecting member 324. If desired, however, the area of reduced thickness may have any other suitable construction, or may be formed at any other suitable location on the end cap 300, that desirably facilitates quick and easy separation of the breakaway member 302 from the end piece 304. The coupling portion 306 may instead comprise any other suitable structure in accordance with alternative embodiments of the invention, such as, for example, perforations 406 (see FIG. 20), an adhesive, fasteners or the like located or formed at any suitable position or location on the end cap 300.

In accordance with the illustrated embodiment, except for the inclusion of its coupling portion 306 and the pair of gaps 332, each end cap 300 has the same general configuration as the end caps 23 described above. In this regard, cantilevered members 340 desirably may also be associated with the connecting members 320 of both the breakaway member 302 and the end piece 304 to define slots 342 extending along the breakaway member and the end piece for engaging the top slat 12' so that the top slat 12' can be engaged by both the breakaway member and the end piece.

The breakaway members 302 desirably may be manually separated from their respective end pieces 304 in any suitable manner and either before, during or after the engagement of the end caps 300 with the respective ends of the storage rail 14. In accordance with a preferred embodiment of the invention, for example, the breakaway members 302 can be separated from their respective end pieces 304 in accordance with the following steps. After the unnecessary slats are stored within the storage rail 14, the end caps 300 are engaged with respective ends of the storage rail. One of the end caps 300 is slidingly moved in a backward or distal direction such that breakaway member 302 remains engaged with a respective end of the storage rail 14, the end piece 304 extends beyond the respective end, and the coupling portion 306 aligns generally with the respective end of the storage rail. The installer can then manually apply an upward force on the end piece 304 inducing the end cap 300 to break at the coupling portion 306 and causing the breakaway member 302 to separate from the end piece 304. It may be desirable to apply the force to the end piece 304 in an up-and-down manner until a complete break occurs. The breakaway member 302 can then be slid or otherwise moved to the desired location along the length of the storage rail 14 to prevent buckling of the stored slats and otherwise retain the stored slats within the storage rail 14. The end piece 304 can then be re-engaged with the end of the, storage rail desirably also to retain the slats within the storage rail 14. These steps may then be repeated in connection with the other end cap 300 at the other end of the storage rail 14. Thereafter, the top slat 12' may be engaged with the breakaway members 302 and the end pieces 304.

Figure 19:
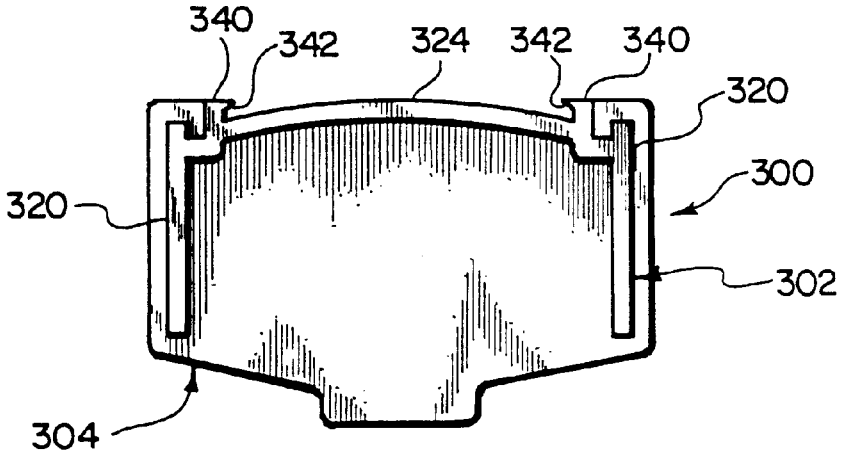
FIG. 19 is a front elevation view of an end cap in accordance with an embodiment similar to the embodiment of FIGS. 16–18.

FIG. 19 illustrates an end cap 300' that is similar in construction to the end cap 300 illustrated in FIGS. 16–18, except that the connecting member 324' of end cap 300' is arcuate. The arcuate construction of the connecting member 324' complements the bowed configuration of the slats 12, and, thus, may better accommodate the cover slat and also may provide additional storage area within the storage rail 14 to enable a greater number of slats to be stored therein.

In accordance with further embodiments, the invention can be employed in other window treatments, such as, for example, pleated or honeycomb window shades. The window treatments in accordance with these further embodiments of the invention include the storage rail and the retainer for retaining a lower, unnecessary portion of the shade within the channel of the storage rail to adjust the length of the window treatment. The retainer includes structure capable of retaining the lower, unnecessary portion of the shade within the channel of the storage rail.

The foregoing description is for purposes of illustration only and is not intended to limit the scope of protection accorded this invention. The scope of protection is to be measured by the following claims, which should be interpreted as broadly as the inventive contribution permits.

The claimed invention is:

1. A storage rail assembly for a blind assembly including a plurality of interconnected slats, the storage rail assembly comprising:

(a) an elongated storage rail including a pair of opposed walls defining a channel for receiving some of the slats; and (b) an end cap associated with an end of the storage rail, the end cap including a breakaway member, an end piece, and a coupling portion removably coupling together the breakaway member and the end piece, the breakaway member adapted to be separated from the end piece and engageable with the opposed walls of the storage rail for substantially preventing any of said some of the slats from buckling outside of the storage rail.

2. The storage rail assembly of claim 1 wherein the coupling portion comprises an area of reduced thickness of the end cap.

3. The storage rail assembly of claim 2 wherein the end cap comprises a connecting member connecting together a pair of opposed walls of the breakaway member and connecting together a pair of opposed walls of the end piece, the area of reduced thickness being formed on the connecting member.

4. The storage rail assembly of claim 3 wherein the end cap defines a pair of gaps adjacent the area of reduced thickness, each gap separating one opposed wall of the breakaway member from a respective opposed wall of the end piece.

5. The storage rail assembly of claim 3 wherein the breakaway member and the end piece each includes a pair of engaging members for engaging one of the other slats to substantially enclose the channel.

6. The storage rail assembly of claim 5 wherein each engaging member comprises a cantilever defining a slot.

7. The storage rail assembly of claim 6 wherein each cantilever includes a chamfered bottom to complement a bowed configuration of said one of the other slats.

8. The storage assembly of claim 3 wherein the connecting member is generally arcuate to complement a bowed configuration of the slats.

9. The storage rail assembly of claim 1 wherein the breakaway member includes a pair of opposed walls and a connecting member connecting together the opposed walls of the breakaway member, the connecting member for preventing said any of said some of the slats from buckling outside of the channel.

10. The storage rail assembly of claim 1 wherein the breakaway member includes a pair of engaging members for engaging one of the other interconnected slats.

11. The storage rail assembly of claim 10 wherein the engaging members define a pair of inwardly-facing slots for receiving said one of the other interconnected slats.

12. The storage rail assembly of claim 10 wherein the breakaway member includes a pair of opposed walls and the end cap further includes a connecting member connecting together the pair of opposed walls of the breakaway member, the connecting member for substantially preventing said any of said some of the slats from buckling outside of the channel, the engaging members extending from a top side of the connecting member.

13. The storage rail assembly of claim 10 wherein the coupling portion comprises an area of reduced thickness.

14. The storage rail assembly of claim 1 wherein the end cap include a connecting member connecting together a pair of opposed walls of the breakaway member and connecting together a pair of opposed walls of the end piece, the connecting member extending substantially the entire length of the end cap.

15. The storage rail assembly of claim 14 wherein the coupling portion comprises an area of reduced thickness formed on the connecting member.

16. The storage rail assembly of claim 1 wherein there are two end caps, each end cap associated with a respective end of the storage rail.

17. A storage rail assembly for a blind assembly including a plurality of interconnected slats, the storage rail assembly comprising:

(a) an elongated storage rail including a pair of ends and a pair of opposed walls defining a channel for receiving some of the slats; and (b) a pair of end caps, each end cap associated with a respective end of the storage rail and including a breakaway member, an end piece, and a coupling portion removably joining together the breakaway member and the end piece, the breakaway member adapted to be separated from the end piece and be engageable with the opposed walls of the storage rail for substantially preventing any of said some of the slats from buckling outside of the storage rail.

18. The storage rail assembly of claim 17 wherein each coupling portion comprises an area of reduced thickness.

19. The storage rail assembly of claim 18 wherein each breakaway member comprises a pair of opposed walls and each end piece comprises a pair of opposed walls, and wherein each end cap comprises a connecting member connecting together the opposed walls of the breakaway members and connecting together the opposed walls of the end piece, the area of reduced thickness of each end cap being formed on the connecting member.

20. The storage rail assembly of claim 19 wherein each end cap defines a pair of gaps adjacent the area of reduced thickness, each gap separating one opposed wall of a respective breakaway member from a respective opposed wall of a respective end piece.

21. The storage rail assembly of claim 17 wherein each coupling portion comprises perforations.

22. The storage rail assembly of claim 17 wherein each breakaway member is adapted to be positioned adjacent a respective vertical cord of the blind assembly.

* * * * *